US009823613B2

(12) United States Patent
Ikeda

(10) Patent No.: US 9,823,613 B2
(45) Date of Patent: Nov. 21, 2017

(54) IMAGE FORMING APPARATUS HAVING A WHITE TONER

(71) Applicant: FUJI XEROX CO., LTD., Tokyo (JP)

(72) Inventor: Miho Ikeda, Ebina (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/249,759

(22) Filed: Aug. 29, 2016

(65) Prior Publication Data

US 2017/0269517 A1 Sep. 21, 2017

(30) Foreign Application Priority Data

Mar. 18, 2016 (JP) ..... 2016-056161

(51) Int. Cl.
*G03G 15/00* (2006.01)

(52) U.S. Cl.
CPC ..... *G03G 15/6585* (2013.01); *G03G 15/6588* (2013.01); *G03G 2215/00489* (2013.01)

(58) Field of Classification Search
CPC ..... G03G 15/0105; G03G 15/6585; G03G 15/6588; G03G 15/6591; G03G 2215/00489
USPC ..... 399/40, 45, 223
See application file for complete search history.

(56) References Cited

U.S. PATENT DOCUMENTS 4,890,139 A * 12/1989 Takebe ..... G03G 13/08 399/143
8,298,737 B2 * 10/2012 Kadokura ..... G03G 9/0827 430/107.1
2003/0165766 A1 * 9/2003 Zhang ..... G03G 9/08764 430/124.1
2004/0057748 A1 * 3/2004 Egusa ..... G03G 15/6591 399/107
2011/0211856 A1 * 9/2011 Bettiol ..... G03G 15/0896 399/82
2014/0255053 A1 * 9/2014 Ohshika ..... G03G 15/6585 399/53
2015/0362872 A1 * 12/2015 Kawamura ..... G03G 15/6585 430/105

FOREIGN PATENT DOCUMENTS

JP 2002-108039 A 4/2002
JP 2006209090 A * 8/2006
JP 2009031511 A * 2/2009
JP 2015001628 A * 1/2015 ..... G03G 15/2014
JP 2015064401 A * 4/2015

* cited by examiner

*Primary Examiner* — Robert Beatty
(74) *Attorney, Agent, or Firm* — Oliff PLC

(57) ABSTRACT

An image forming apparatus includes an image forming unit that forms, when forming an image with a white toner on a colored recording medium, a base toner layer and a white toner layer in an overlapped manner such that the base toner layer is inserted between the white toner layer and the colored recording medium, and a fixing unit that fixes the base toner layer and the white toner layer that are formed by the image forming unit on the recording medium.

6 Claims, 10 Drawing Sheets

| TRAY | SHEET TYPE | SHEET SIZE | SHEET COLOR |
|---|---|---|---|
| TRAY 1 | PLAIN PAPER | A4 | WHITE |
| TRAY 2 | UNCOATED PAPER | A4 | BLACK |

| SHEET COLOR | BLACK | GREEN | RED | YELLOW | BROWN | BLUE | LIGHT BLUE | PINK | SKIN COLOR | GRAY | NAVY |
|---|---|---|---|---|---|---|---|---|---|---|---|
| PARTICULAR COLOR | Y | Y | M | Y | Y | C | C | M | Y | C | C |

IMAGE FORMING APPARATUS HAVING A WHITE TONER

CROSS-REFERENCE TO RELATED APPLICATIONS

This application is based on and claims priority under 35 U.S.C. 119 from Japanese Patent Application No. 2016-056161 filed Mar. 18, 2016.

TECHNICAL FIELD

The present invention relates to an image forming apparatus.

SUMMARY

According to an aspect of the invention, an image forming apparatus includes an image forming unit that forms, when forming an image with a white toner on a colored recording medium, a base toner layer and a white toner layer in an overlapped manner such that the base toner layer is inserted between the white toner layer and the colored recording medium, and a fixing unit that fixes the base toner layer and the white toner layer that are formed by the image forming unit on the recording medium.

BRIEF DESCRIPTION OF THE DRAWINGS

Exemplary embodiments of the present invention will be described in detail based on the following figures, wherein.

DETAILED DESCRIPTION

Hereinafter, exemplary embodiments of the present invention will be described with reference to the drawings.

Image Forming Apparatus

Figure 1:
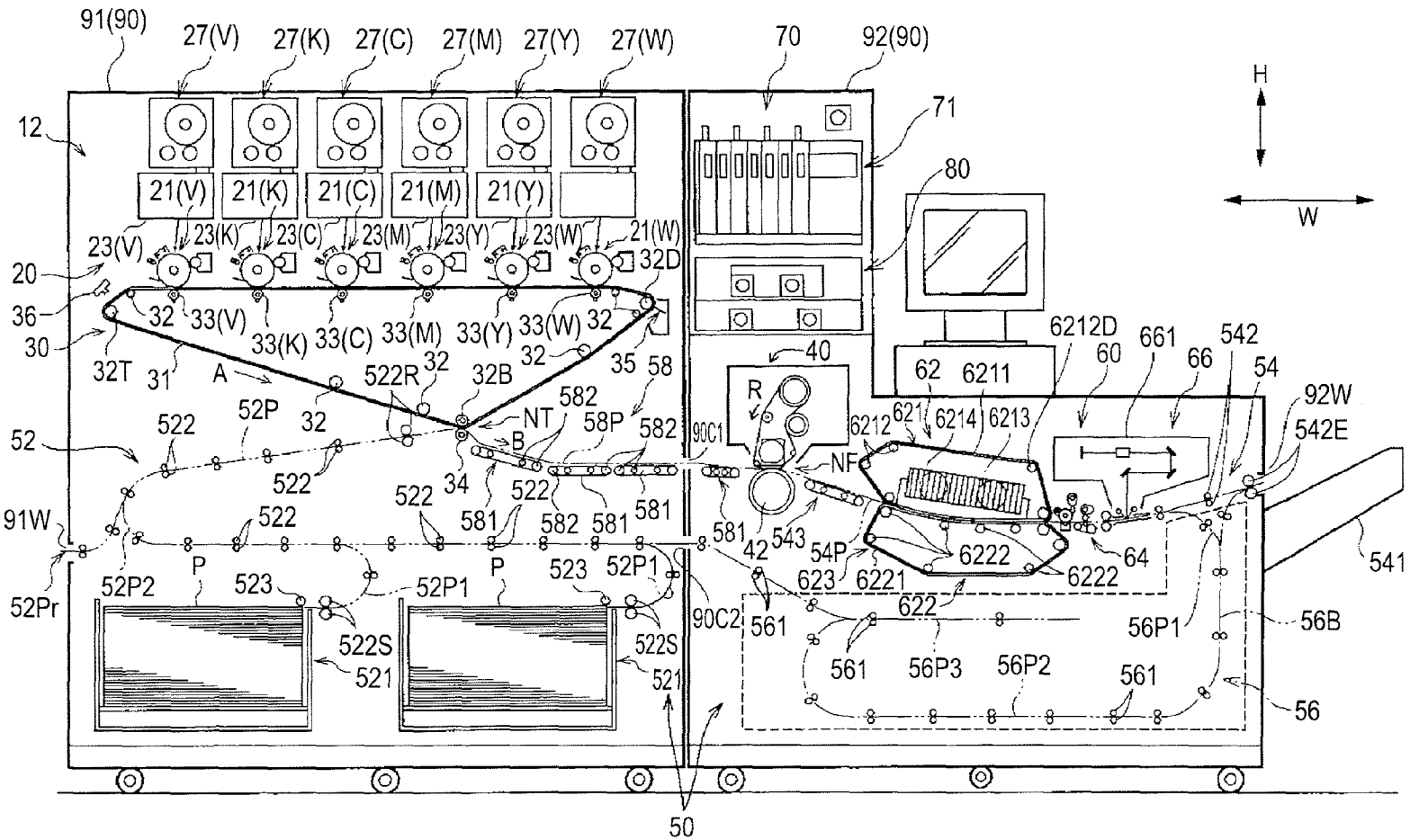
FIG. 1 is a schematic diagram illustrating an example of a configuration of an image forming apparatus according to a first exemplary embodiment of the invention.
Figure 2:
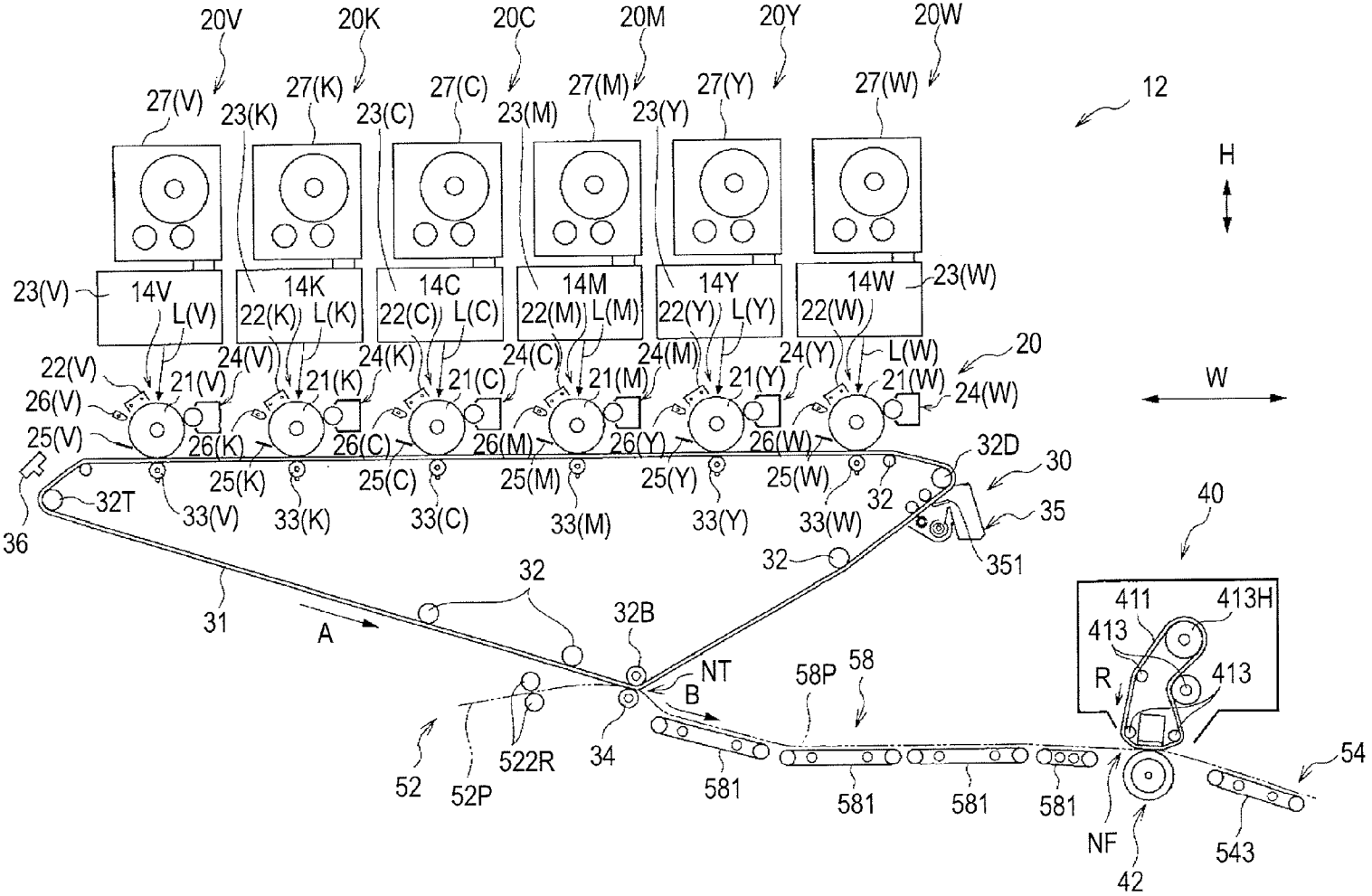
FIG. 2 is a configuration diagram schematically illustrating a configuration of an image forming unit (main components) of the image forming apparatus illustrated in FIG. 1.

First, the image forming apparatus will be described. FIG. 1 is a configuration diagram schematically illustrating an example of a configuration of the image forming apparatus according to the exemplary embodiment of the invention. FIG. 2 is a configuration diagram schematically illustrating a configuration of the image forming unit (main components) of the image forming apparatus illustrated in FIG. 1. In the drawings, an arrow H represents a vertical direction, and an arrow W represents a horizontal direction, which is a width direction of the apparatus.

As illustrated in FIG. 1, an image forming apparatus 10 has an image forming unit 12 that forms an image on a recording medium P as a recording medium by an electrophotographic process, a medium transport device 50 that transports the recording medium P, and a post-processing unit 60 that performs a post process on the recording medium P on which the image is formed. In addition, the image forming apparatus 10 further has a power supply unit 80 that supplies power to the respective units of the apparatus, and a controller 70 that controls the respective units of the apparatus.

The image forming unit 12 has a toner image forming unit 20 that forms a toner image, a transfer device 30 that transfers the toner image formed by the toner image forming unit 20 to the recording medium P, and a fixing device 40 that fixes the toner image transferred to the recording medium P on the recording medium P.

The medium transport device 50 has a medium supply unit 52 that supplies the recording medium P to the image forming unit 12, and a medium output unit 54 that outputs the recording medium P on which the toner image is formed. The medium transport device 50 further has a medium returning unit 56 and an intermediate transport unit 58 which are used at the time of forming images on both surfaces of the recording medium P.

The post-processing unit 60 has a medium cooling unit 62 that cools the recording medium P to which the toner image is transferred by the image forming unit 12, a correcting device 64 that corrects a curve of the recording medium P, and an image inspecting unit 66 that inspects the image formed on the recording medium P. The respective components constituting the post-processing unit 60 are disposed in the medium output unit 54 of the medium transport device 50.

The components of the image forming apparatus 10 are accommodated in a housing 90 except for an output medium receiving portion 541. The housing 90 in the exemplary embodiment is divided into a first housing 91 and a second housing 92 which are adjacent to each other in the width direction of the apparatus. With this, a transporting unit of the image forming apparatus 10 is miniaturized in the width direction of the apparatus.

The first housing 91 accommodates main components of the image forming unit 12 except for the fixing device 40 and the medium supply unit 52. The second housing 92 accommodates the fixing device 40, the medium output unit 54, the medium cooling unit 62, the image inspecting unit 66, the medium returning unit 56, the controller 70, and the power supply unit 80 which constitute the image forming unit 12.

The first housing 91 and the second housing 92 are coupled to each other by a fastening tool such as a bolt and a nut (not shown as one example of components). A communication opening portion 90C1 through which the recording medium P passes from a transfer nip NT of the image forming unit 12 to a fixing nip NF, and a communication path 90C2 through which the recording medium P passes from the medium returning unit 56 to the medium supply unit 52 are formed between the first housing 91 and the second housing 92 in a coupled state.

Image Forming Unit

Hereinafter, the "image forming unit" will be described.

The image forming unit 12 has the toner image forming unit 20, the transfer device 30, and the fixing device 40. In the exemplary embodiment, toner image forming units 20V, 20W, 20Y, 20M, 20C, and 20K that form toner images are provided for respective colors such as a first spot color (V), a second spot color (W), yellow (Y), magenta (M), cyan (C), and black (K).

The toner image forming units 20V, 20W, 20Y, 20M, 20C, and 20K are arranged in order of 20W→20Y→20M→20C→20K→20V of the toner image forming units along the upper side portion of the transfer belt 31 from the upstream side in the moving direction of the transfer belt 31. That is, the toner images are formed on the transfer belt 31 in order of a W color image→a Y color image→an M color image→a C color image→a K color image→a V color image.

In addition, in the exemplary embodiment, the first spot color (V) is transparent, and the toner image forming unit 20V forms a toner image with a transparent toner. On the other hand, the second spot color (W) is white, and the toner image forming unit 20W forms a toner image with white toner. Note Details of the transparent toner and the white toner, and the control of the components which is performed by the controller 70 when an image is formed with the white toner on the colored recording medium will be described below.

Each of the toner image forming units 20V, 20W, 20Y, 20M, 20C, 20K is formed in a similar way. If there is no need to distinguish the aforementioned units for each color, it is referred to as a toner image forming unit 20. The toner image forming unit 20 has an image forming unit 14, and a toner cartridge 27 which holds toner, as illustrated in FIG. 2. The image forming unit 14 provided for each color will be described without being distinguished for each color. The image forming unit 14 has a photoconductor drum 21 (an example of the image carrier), a charging unit 22, an exposure device 23, a developing device 24 (an example of a developing device), a cleaning unit 25, and a charge eliminating unit 26.

A photoreceptor layer is formed on the surface of the photoconductor drum 21. The charging unit 22 causes a surface (the photoreceptor layer) of the photoconductor drum 21 to be charged through a corona discharging process. The exposure device 23 irradiates the surface of the photoconductor drum 21 which is charged by the charging unit 22 with exposure light L so as to form an electrostatic latent image on the surface of the photoconductor drum 21. The exposure light L is modulated in response to image data obtained from an image signal processing portion 71 (see FIG. 1) of the controller 70. The developing device 24 develops an electrostatic latent image formed on the surface of the photoconductor drum 21 by using a developer G containing toner so as to form a toner image on the surface of the photoconductor drum 21.

The cleaning unit 25 is formed into a blade shape, and scrapes the toner remaining on the surface of the photoconductor drum 21 after transferring the toner image to the transfer device 30 from the surface of the photoconductor drum 21. The charge eliminating unit 26 eliminates a charge by irradiating the transferred photoconductor drum 21 with light. With this, a charging history of the surface of the photoconductor drum 21 is canceled. The toner cartridge 27 supplies toner to the developing device 24.

The transfer device 30 primarily transfers the toner images of the photoconductor drums 21 for the respective colors to the transfer belt 31 in a superimposed manner, and then secondarily transfers the superimposed toner image to the recording medium P. Hereinafter, the details will be described.

The transfer belt 31 is an endless belt type as illustrated in FIG. 2, and is wound around plural rollers 32. A roller 32D serves as a driving roller which causes the transfer belt 31 to be rotated by a driving force of a motor (not shown) in an arrow A direction. In addition, a roller 32T serves as a tensioning roller which imparts tension to the transfer belt 31. A peak portion on the lower end side which forms an obtuse angle of the transfer belt 31 is wound around a roller 32B. The roller 32B serves as a facing roller of a secondary transfer roller 34 which is described below. The transfer belt 31 comes in contact with the lower side of the photoconductor drum 21 for each color in the upper side portion extending in the width direction of the apparatus.

A primary transfer roller 33 which is an example of a transfer member for transferring the toner images in the photoconductor drums 21 to the transfer belt 31 is disposed on the inside of the transfer belt 31. Each of the primary transfer rollers 33 is disposed so as to face the photoconductor drum 21 in the corresponding color with the transfer belt 31 interposed therebetween. In addition, a transfer bias voltage having an opposite polarity to the toner polarity is applied to the primary transfer roller 33. By applying such a transfer bias voltage to the primary transfer roller 33, the toner image formed on the photoconductor drum 21 is transferred to the transfer belt 31.

The transfer device 30 has a secondary transfer roller 34 for transferring the toner image superimposed on the transfer belt 31 to the recording medium P. The secondary transfer roller 34 is disposed between the rollers 32B with the transfer belt 31 interposed therebetween, and has the transfer nip NT formed between the secondary transfer roller 34 and the transfer belt 31. The recording medium P is supplied to the aforementioned transfer nip NT from the medium supply unit 52 in a timely manner. A transfer bias voltage having an opposite polarity to the toner polarity is applied to the secondary transfer roller 34 by a feeding portion (not shown). By applying the transfer bias voltage to the secondary transfer roller 34, the toner image is transferred to the recording medium P passing through the transfer nip NT from the transfer belt 31.

The transfer device 30 further has a cleaning unit 35 that cleans the transfer belt 31 after performing the secondary transfer. The cleaning unit 35 is disposed downstream of a portion (transfer nip NT) in which the secondary transfer is performed in the circumference direction of the transfer belt 31, and upstream of a portion in which the primary transfer is performed in the circumference direction of the transfer belt 31. The cleaning unit 35 has a blade 351 for scrapping the toner remaining on the surface of the transfer belt 31.

The fixing device 40 fixes the toner image on the recording medium P to which the toner image is transferred in the transfer device 30. In the exemplary embodiment, the fixing device 40 fixes the toner image to the recording medium P by heating and pressurizing the toner image in the fixing nip NF which is formed by the fixing belt 411, which is wound around plural rollers 413, and the pressure roller 42.

A roller 413H is configured as a heating roller having a heater therein and is rotated by a driving force transferred from a motor (not shown). With this, the fixing belt 411 is rotated in an arrow R direction. In addition, the pressure roller 42 is also rotated at the same circumferential speed as that of the fixing belt 411 by the driving force transferred from the motor (not shown).

Medium Transport Device

Here, the "medium transport device" will be described in detail.

The medium transport device 50 includes the medium supply unit 52, the medium output unit 54, the medium returning unit 56, and the intermediate transport unit 58.

The medium supply unit 52 has a container 521 accommodating the recording mediums P in a state of being stacked. In the exemplary embodiment, two containers 521 are disposed side by side in the width direction of the apparatus, on the lower side of the transfer device 30. A medium supply path 52P is formed from each of the containers 521 to the transfer nip NT which is a portion for the secondary transfer by plural pairs of the transport rollers 522.

A feeding roller 523 for feeding the uppermost one of the recording media P stacked on the container 521 is disposed on the upper side of each of the containers 521. Among the plural pairs of transport rollers 522, the pairs of transport rollers 522S most upstream in the transport direction of the recording medium P serve as a separation roller which separates the recording media P, which are fed by the feeding roller 523 in a stacked state from the container 521, one by one. In addition, among the plural pairs of transport rollers 522, pairs of transport rollers 522R positioned immediately upstream of the transfer nip NT in the transport direction of the recording medium P are operated such that moving timing of the toner image on the transfer belt 31 and a transporting timing of the recording medium P are matched with each other.

The medium supply unit 52 further has a preliminary transporting path 52Pr. The preliminary transporting path 52Pr starts from an opening portion 91W on the side opposite to the second housing 92 side of the first housing 91, and joins a turning-back portion 52P2 of the medium supply path 52P. The preliminary transporting path 52Pr is set as a transporting path at the time of sending the recording medium P which is fed from an optional recording medium supply device (not shown) disposed to be adjacent to the opening portion 91W side of the first housing 91 to the image forming unit 12.

The intermediate transport unit 58 is disposed between the transfer nip NT of the transfer device 30 and the fixing nip NF of the fixing device 40. The intermediate transport unit 58 has a plurality of belt transporting members 581 having an endless transport belt wound around the roller. The belt transporting member 581 is configured such that the transport belt is rotated with the recording medium P being sucked onto the surface of the transport belt by suctioning air (negative pressure suction) from the inside so as to transport the recording medium P.

The medium output unit 54 outputs the recording medium P on which the toner image is fixed by the fixing device 40 of the image forming unit 12 to the outside of the housing 90 from the output port 92W of the second housing 92 which is formed at an end portion on the side opposite to the first housing 91 side. The medium output unit 54 has the output medium receiving portion 541 for receiving the recording medium P output from the output port 92W.

The medium output unit 54 includes a medium output path 54P for which the recording medium P is transported to the output port 92W from the fixing device 40 (fixing nip NF). The medium output path 54P is formed by a belt transporting member 543, and the plural pairs of rollers 542. Among the plural pairs of rollers 542, a pair of rollers 542E disposed most downstream in the output direction of the recording medium P serve as output rollers for outputting the recording medium P onto the output medium receiving portion 541.

The medium returning unit 56 has a plurality of pairs of rollers 561. The pairs of rollers 561 form a reverse path 56P, into which the recording medium P having passed through the image inspecting unit 66 is fed, in a case where an image is to be formed on both sides of the recording medium. The reverse path 56P includes a branch path 56P1, a transport path 56P2, and a reverse path 56P3. The branch path 56P1 is branched from the medium output path 54P. The transport path 56P2 allows the recording medium P received from the branch path 56P1 to be fed into the medium supply path 52P. The reverse path 56P3 is provided in an intermediate portion of the transport path 56P2 and turns back the transport direction of the recording medium P which is transported on the transport path 56P2 to the opposite direction (that is, transports the recording medium P in a switch-back manner), thereby reversing the front surface and the back surface of the recording medium P.

Post-Processing Unit

The medium cooling unit 62, the correcting device 64, and the image inspecting unit 66 which constitute the post-processing unit 60 are disposed upstream, in the output direction of the recording medium P, of a portion where the branch path 56P1 is branched on the medium output path 54P of the medium output unit 54 and are arranged in this order from the upstream side in the output direction.

The medium cooling unit 62 has an endothermic unit 621 for absorbing heat of the recording medium P and a pressing unit 622 for pressing the recording medium P to the endothermic unit 621. The endothermic unit 621 is disposed on the upper side of the medium output path 54P, and the pressing unit 622 is disposed on the lower side of the medium output path 54P.

The endothermic unit 621 has an endless endothermic belt 6211, plural rollers 6212 for supporting the endothermic belt 6211, a heat sink 6213 disposed in the inside of the endothermic belt 6211, and a fan 6214 for cooling the heat sink 6213. The endothermic belt 6211 comes in contact with the recording medium P on the outer circumferential surface so as to exchange the heat. Among the plural rollers 6212, a roller 6212D serves as a driving roller for transferring a driving force to the endothermic belt 6211. The heat sink 6213 comes in surface contact with the inner circumferential surface of the endothermic belt 6211 in a predetermined range so as to be slidable along the medium output path 54P.

The pressing unit 622 has an endless pressing belt 6221 and plural rollers 6222 for supporting the pressing belt 6221. The pressing belt 6221 is wound around the plural rollers 6222. The pressing unit 622 presses the recording medium P to the endothermic belt 6211 (heat sink 6213) so as to transport the recording medium P together with the endothermic belt 6211.

The correcting device 64 is provided downstream of the medium cooling unit 62 in the medium output unit 54. The correcting device 64 corrects a curve (curl) of the recording medium P received from the medium cooling unit 62. In addition, an in-line sensor 661 which constitutes one of main components of the image inspecting unit 66 is disposed downstream of the correcting device 64 in the medium output unit 54. The in-line sensor 661 detects existence or the degree of a toner concentration defect, an image defect, an image position defect, and the like of the fixed toner image, based on the light, with which the recording medium P is irradiated, reflected on the recording medium P.

Electrical Configuration of Image Forming Apparatus

Next, the electrical configuration of the image forming apparatus will be described.

Figure 3:
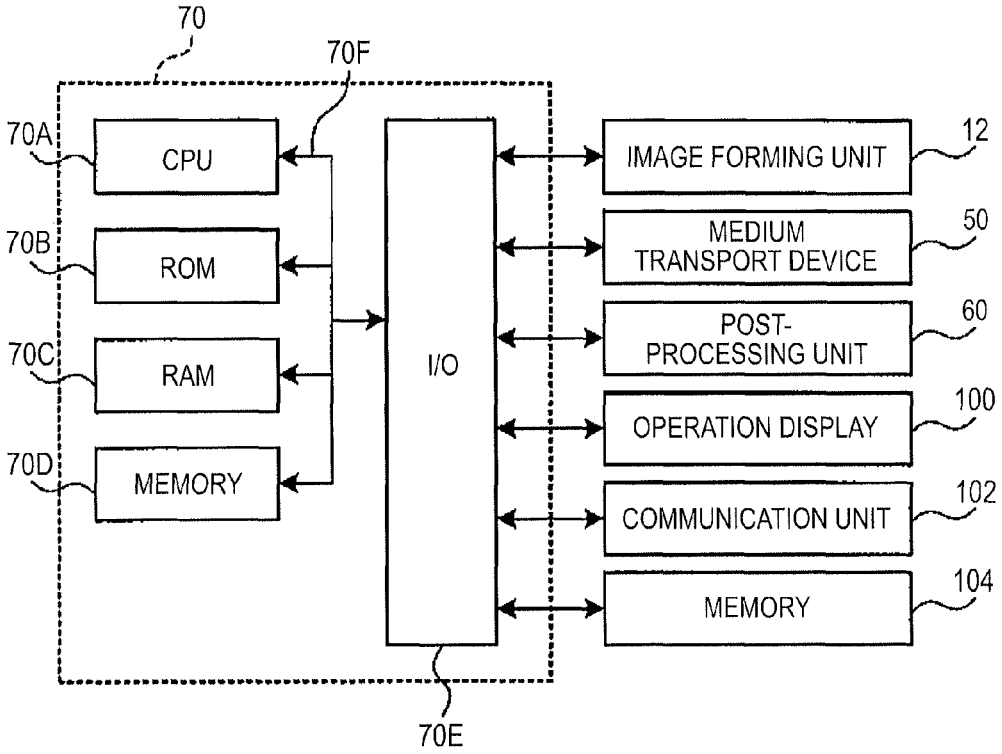
FIG. 3 is a schematic diagram illustrating an example of an electrical configuration of the image forming apparatus according to the first exemplary embodiment.

FIG. 3 is a schematic diagram illustrating an example of an electrical configuration of the image forming apparatus according to the first exemplary embodiment. As illustrated in FIG. 3, the controller 70 serves as a computer which controls the entire apparatus and performs various operations. That is, the controller 70 has a central processing unit (CPU) 70A, a read only memory (ROM) 70B, a random access memory (RAM) 70C, a non-volatile memory 70D, and an input/output (I/O) interface 70E.

The CPU 70A, the ROM 70B, the RAM 70C, the memory 70D, and the I/O 70E are connected to each other via a bus 70F. The CPU 70A reads a program stored in the ROM 70B, and set the RAM 70C as a working area so as to executes the program. The I/O 70E of the controller 70 is connected to each of the image forming unit 12, the medium transport device 50, the post-processing unit 60, operation display 100, a communication unit 102, and memory 104. The controller 70 controls these units.

The operation display 100 includes various buttons such as a start button and a numeric keypad, and a touch panel for displaying various screens such as the setting screen. With such a configuration, the operation display 100 receives an operation of a user, and displays various types of information to the user.

The communication unit 102 is an interface for communicating with an external device via a wired or wireless communication line. For example, the communication unit 102 functions as an interface for communicating with a computer which is connected to a network such as a local area network (LAN). The memory 104 has a storage device such as hard disk. The memory 104 stores various types of data such as log data, a control program, and the like.

The image information may be obtained from an image reader (not shown) provided in the image forming apparatus, or may be obtained from the external device via the communication unit 102. An image forming instruction and selection setting information may be obtained from the operation display 100, or may be obtained from the external device via the communication unit 102. Here, the "selection setting information" means information relating to image forming conditions which are selected and set by the user. In the exemplary embodiment, the selection setting information includes information relating to the types of the recording medium, and the colors of the recording medium. The selection setting information may include other information relating to the image forming conditions such as pages, the number of copies, the size of the recording medium, the number of pages in one sheet of the recording medium, and margin.

Image Forming Operation

Next, an image forming step and a post-processing step which are to be performed on the recording medium P by the image forming apparatus 10 will be described. The image forming step is performed based on a user's selection and various image forming conditions set in advance. In the exemplary embodiment, in the image forming step, a "normal mode" in which an image is formed on the recording medium with a colored toner, and a "white mode" in which an image is formed on the colored recording medium with a white toner are prepared.

In the "white mode", a transparent toner layer is formed to embed unevenness of the surface of the recording medium between a white toner layer and the recording medium. The transparent toner layer is an example of "a base toner layer". As described below, a colored toner layer is an example of the "base toner layer" in the second exemplary embodiment. The toner forming the base toner layer is temporarily referred to as "a base toner". Regardless of the color of the base toner, when the base toner layer is inserted, it is possible to prevent the white toner from being soaked into the recording medium.

Transparent Toner, White Toner and Colored Toner

The transparent toner does not contain a pigment, but contains a binder resin and various types of additives. The white toner contains a white pigment, a binder resin, and various types of additives. The colored toner having each color of yellow (Y), magenta (M), cyan (C), and black (K) contains a color pigment, a binder resin, and various types of additives. The "colored" toner means a toner having a color which is not transparent and white. The aforementioned toners are used as a developer in combination with a carrier.

Each of the transparent toner, the white toner, and the colored toner may have a central particle diameter set in a range of 3 μm to 9 μm, and have specific gravity set in a range of 1 to 1.7. In addition, in the exemplary embodiment, a toner amount of the base toner per unit area at the time of forming the base toner layer is set in advance in accordance with the type of the recording medium.

For example, in a case where the recording medium is an uncoated paper, the unevenness of the recording medium is embedded by forming the base toner on the recording medium in a range of 0.7 layers to 1 layer. Accordingly, in a case of using the base toner which has the central particle diameter of 6 μm and the specific gravity of 1.1, the toner amount of the base toner per unit area may be set in a range of 3 $g/m^2$ to 4 $g/m^2$.

In a case where the surface of the recording medium is flattened through the embodiment of the unevenness of the recording medium, the white toner is formed on the recording medium in a range of 1 layer to 1.5 layers, and thus it is possible to obtain a preferable white color density. Accordingly, in a case of using the white toner which has the central particle diameter of 6 μm and the specific gravity of 1.1, the toner amount of the white toner per unit area is set in a range of 4 $g/m^2$ to 6 $g/m^2$.

In addition, in a case of imparting the same amount of heat for fixing, the storage modulus of the base toner may be lower than the storage modulus of the white toner such that the base toner is easily soaked into the recording medium by the white toner. Here, the "storage modulus" indicates real portions of shear complex modulus G* at a measuring frequency f [Hz], and a unit thereof is pascal (Pa). Specifically, the storage modulus is a value measured by a storage modulus measuring apparatus based on a method defined in JIS K 7244-6 "Plastics, Determination of dynamic mechanical properties, Part 6: Shear vibration—Non-resonance method".

For example, the storage modulus of the base toner (the transparent toner or the colored toner) at a measuring frequency of 1 Hz may be set to be in a range of $1.0\times10^{3.5}$ [Pa] to $1.0\times10^{4.2}$ [Pa], and the storage modulus of the white toner may be set to be in a range of $1.0\times10^{4.2}$ [Pa] to $1.0\times10^{5}$ [Pa]. Meanwhile, the amount of heat for fixing is changed in accordance with the fixing temperature and the fixing time, and the numerical value of the storage modulus is changed in accordance with the amount of heat for fixing. Here, in a case of imparting the same amount of heat for fixing, the storage modulus of the base toner is set to be lower than the storage modulus of the white toner.

Recording Medium

In the image forming apparatus, recording media of different types are used. In the exemplary embodiment, an image forming apparatus 10 has two containers 521 in which the recording media P are stacked and accommodated (see FIG. 1). The two of the containers 521 may accommodate various types of the recording media which have different colors and sizes from each other. The types, colors, and sizes of the recording media accommodated in the container 52 are set and registered for each of the containers 52 by the user. That is, the user sets the color of the recording medium as a white color or another color other than the white color.

Figures 4, 5:
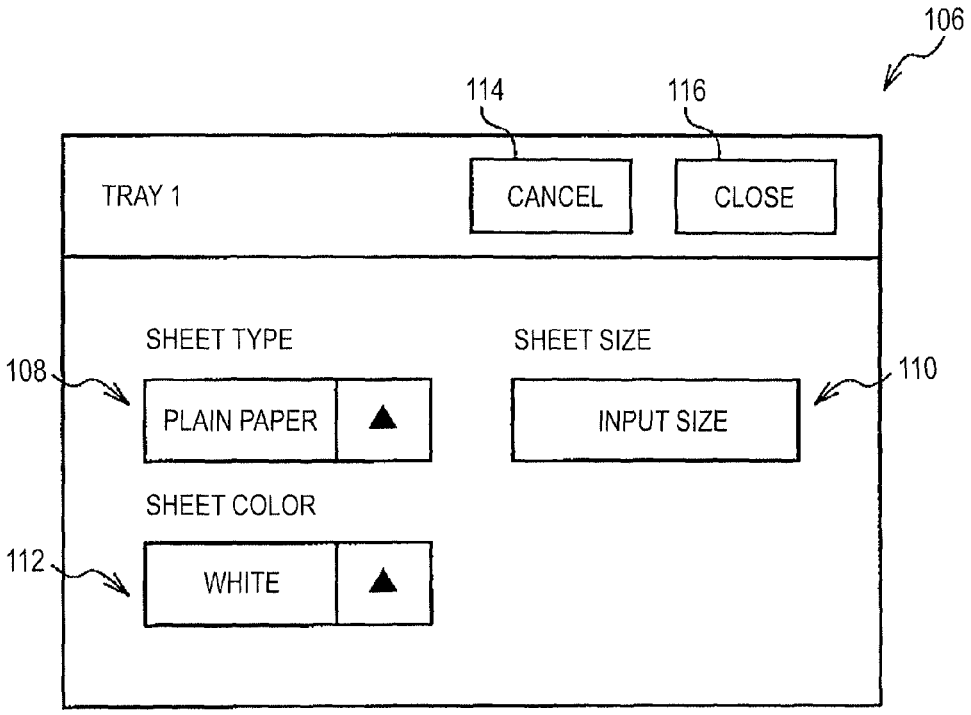
FIG. 4 is a schematic diagram illustrating an example of a setting screen displayed on an operation display.
FIG. 5 is a table indicating an example of a relationship between a tray and an attribute of a recording medium.

Hereinafter, the two containers 521 are referred to as "a tray 1 and a tray 2", or the recording medium is referred to as "a sheet". FIG. 4 is a schematic diagram illustrating an example of a setting screen displayed on an operation display. As illustrated in FIG. 4, the operation display 100 displays a setting screen 106 for setting a sheet type, a sheet color, and a sheet size. An example illustrated in FIG. 4 is a setting screen for the "tray 1".

The setting screen 106 includes a setting unit 108 that selects and sets the sheet type, such as a plain paper, a uncoated paper, and a recycled paper, an input unit 110 that inputs the sheet size, a setting unit 112 that selects and sets the sheet color such as white, pink, light blue, and black, a cancel button 114, and close button 116. The user sets the sheet type, the sheet color, and the sheet size for the tray 1 by operating the setting screen 106. Similarly, the user sets the sheet type, the sheet color, and the sheet size for the tray 2.

The relationship between the tray and the sheet type, the sheet color, and the sheet size which are set described above is stored in a memory 70D or the like of the controller 70 in a table form as illustrated in FIG. 5, for example. Accordingly, when the user selects the tray, the sheet type, the sheet color, and the sheet size are also selected. That is, the type, the color, and the size of the recording medium are selected by selecting the container.

Mode Selection Process

Next, the mode selection process will be described.

Figure 6:
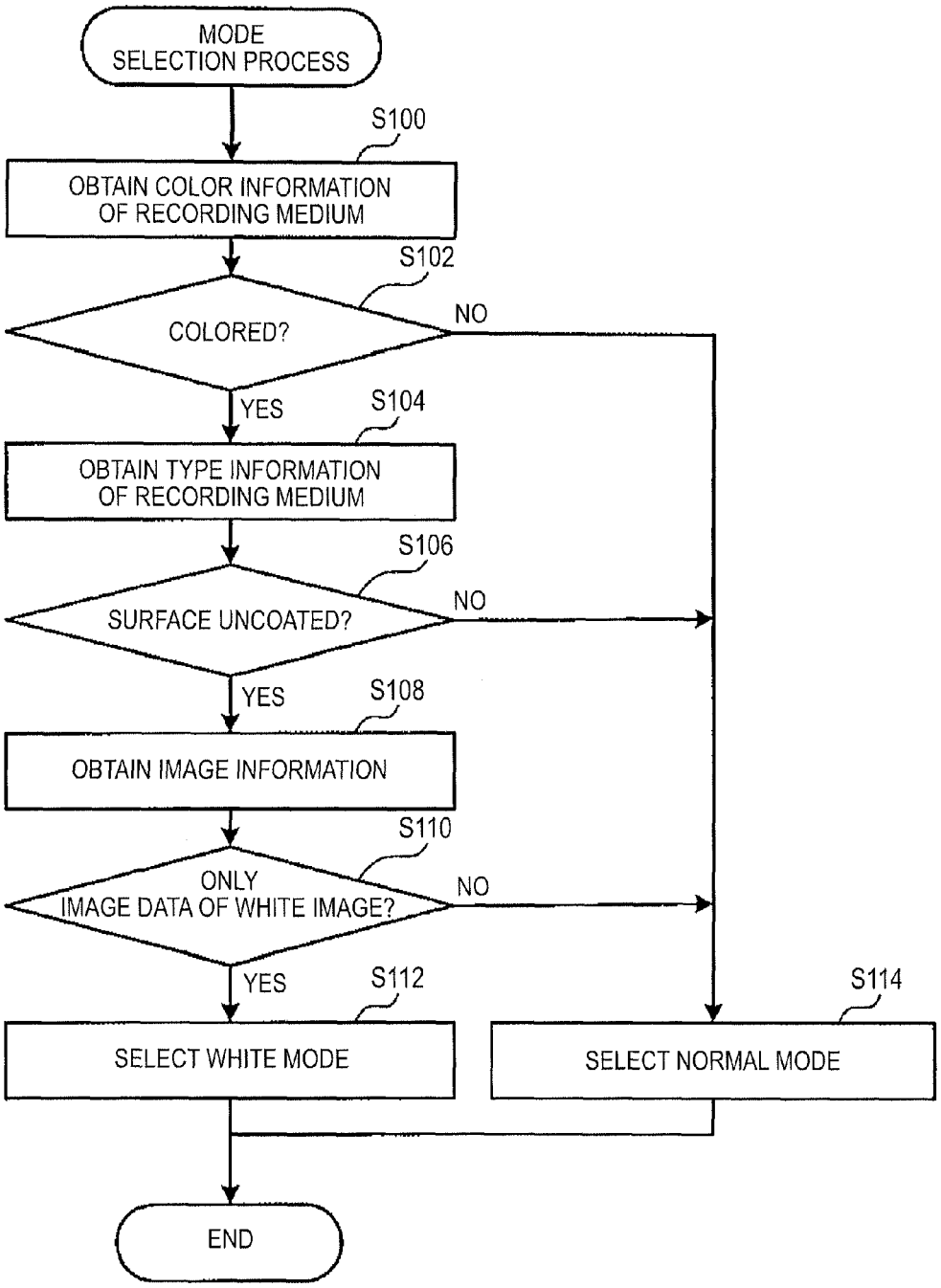
FIG. 6 is a flowchart illustrating an example of procedure of a mode selection process.

In the exemplary embodiment, a mode selection process of selecting any one of the normal mode and the white mode is performed before the image forming process. FIG. 6 is a flowchart illustrating an example of procedure of the mode selection process. The mode selection process is performed by the CPU 70A of the controller 70.

Further, the mode selection process is started as soon as the controller 70 receives the image forming instruction, the selection setting information, and the image information from the user. In a case of the image forming instruction, the user may select the type, the color, the size of the recording medium by selecting the container. The controller 70 receives the image forming instruction and selection setting information as well.

First, in Step 100, color information of the recording medium is obtained, and in Step 102, it is determined whether or not the recording medium is colored. In a case of the colored recording medium, the process proceeds to Step 104. In contrast, in a case of a non-colored recording medium, the process proceeds to Step 114, and the normal mode is selected.

Subsequently, in Step 104, type information of the recording medium is obtained, and in Step 106, it is determined whether or not the surface of the recording medium is coated. In a case where the surface of the recording medium is not coated, the process proceeds to Step 108. In a case where the surface of the recording medium is coated, the process proceeds to Step 114, and the normal mode is selected.

Next, in Step 108, the image information is obtained, and in Step 110, it is determined whether or not the image information only includes image data of a white image. In a case where the image information only includes the image data of the white image, the process proceeds to Step 112, and the white mode is selected. In a case where the image information includes image data other than the image data of the white image, the process proceeds to Step 114, the normal mode is selected.

With the above-described mode selection process, in a case where the recording medium is colored and the surface thereof is not coated, and the image information only includes the image data of the white image, the "white mode" in which the base toner layer is formed with the transparent toner is selected. In a case where the "white mode" is not selected, the "normal mode" is selected. The controller 70 performs the image forming command in accordance with the selected mode.

In the mode selection process, in a case where the recording medium is colored and the surface thereof is not coated, and the image information only includes the image data of the white image, the "white mode" is selected by the controller 70; however, a selection screen having options such as the "normal mode" and the "white mode" is displayed to the user, and any one of them may be selected by the user. In addition, the selecting conditions for the "white mode" may be alleviated such that the surface of the recording medium is not necessarily coated, and the image information includes image data other than the image data of the white image.

Either one of the "normal mode" and the "white mode" may be selected in accordance with "physical properties which are correlated to the surface roughness of the recording medium". "The physical properties which are correlated to the surface roughness of the recording medium" are stored in advance in accordance with the type of the recording medium such as a plain paper, a recycled paper, and an uncoated paper. Then, in a case where the "white mode" is selected, the toner amount per unit area at the time of forming of the base toner layer may be set in accordance with the physical properties.

For example, the "physical properties which are correlated to the surface roughness of the recording medium" include smoothness, glossiness, and the like of the recording medium. With respect to the recording medium having the smoothness which is equal to or shorter than 1000 seconds and the glossiness at 60° C. is equal to or less than 10, which means the recording medium has the smoothness and the glossiness which are equal to or less than a threshold value, the "white mode" may be selected. Here, the "smoothness" means surface smoothness based on a Bekk smoothness tester (see JIS P 8119). In addition, the "glossiness (glossiness at 60° C.)" is an index obtained by irradiating a target object with light under the condition of an incidence angle of 60°, and then measuring reflected light (see JIS Z 8741).

Normal Mode

Figure 7:
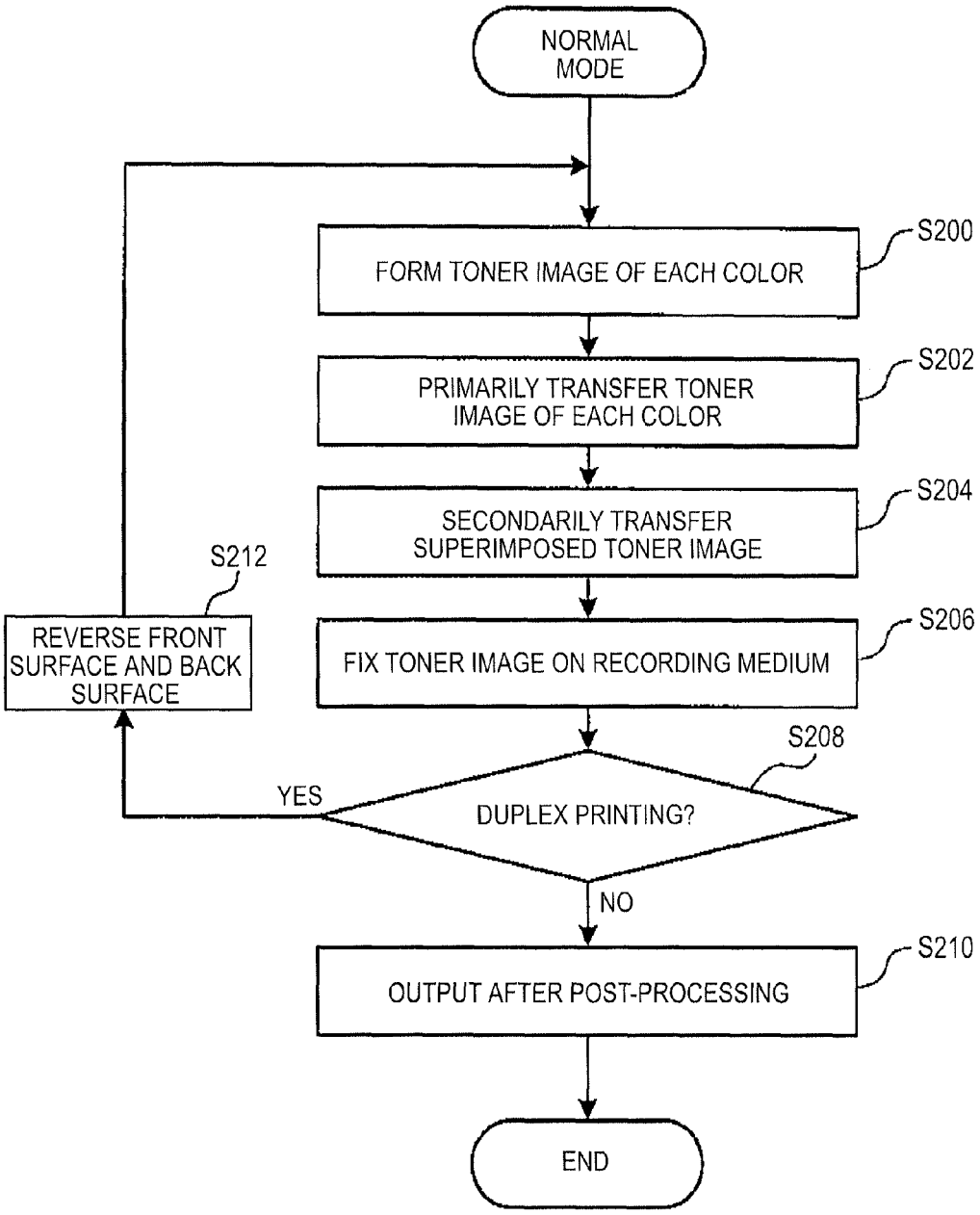
FIG. 7 is a flowchart illustrating an example of procedure of an image forming process in a normal mode.

FIG. 7 is a flowchart illustrating an example of procedure of an image forming process in a normal mode. An image forming step and a post-processing step in the "normal mode" will be described with reference to FIG. 1 and FIG. 2. The controller 70 which receives the image forming command in the "normal mode" operates the image forming unit 12 (the toner image forming unit 20, the transfer device 30, and the fixing device 40), the medium transport device 50, the post-processing unit 60, and the like. For example, the photoconductor drum 21 of the image forming unit 14 for each color, and a developing roller 242 of the developing device 24 are rotated such that the transfer belt 31 is circulated. In addition, when the pressure roller 42 is rotated, the fixing belt 411 is circulated.

First, in Step 200, the respective components of the image forming unit 12 and the medium transport device 50 are instructed to form the toner image of each color. A toner image having a color corresponding to any one of yellow (Y), magenta (M), cyan (C), and black (K) is formed on the photoconductor drum 21 for each color. Specifically, the photoconductor drum 21 is charged by the charging unit 22, and is exposed to exposure light L in response to the image data of the corresponding color by the exposure device 23, and thereby an electrostatic latent image is formed on the surface of the photoconductor drum 21. The electrostatic latent image which is formed on the photoconductor drum 21 is developed by using a developer of the corresponding color supplied from the developing device 24. With this, the toner image having the corresponding color is formed on the photoconductor drum 21 for each color.

Next, in Step 202, the respective components of the image forming unit 12 and the medium transport device 50 are instructed to primarily transfer the toner image of each color. The toner image of each color which is formed on the photoconductor drum 21 for each color is sequentially transferred to the circulating transfer belt 31 through the applying of a transfer bias voltage through the primary transfer roller 33 for each color. With this, a superimposed toner image obtained by superimposing toner images of six colors is formed on the transfer belt 31. In the exemplary embodiment, toner images of four colors are superimposed in order of a Y color image, an M color image, a C color image, and a K color image from the transfer belt 31 side. The superimposed toner image is transported to the transfer nip NT by the circulation of the transfer belt 31.

Next, in Step 204, the respective components of the image forming unit 12 and the medium transport device 50 are instructed to secondarily transfer the superimposed toner image. The recording medium P is supplied to the transfer nip NT by the pairs of transport rollers 522R of the medium supply unit 52 in accordance with the timing of the transporting the superimposed toner image. When the transfer bias voltage is applied to the transfer nip NT, the superimposed toner image is transferred to the recording medium P from the transfer belt 31. After performing the transfer, the toner images of the four colors are superimposed in order of the K color image, the C color image, the M color image, and the Y color image from the recording medium P side.

Next, in Step 206, the respective components of the image forming unit 12 and the medium transport device 50 are instructed to fix the toner image on the recording medium P. The recording medium P to which the superimposed toner image is transferred is transported to the fixing nip NF of the fixing device 40 by the intermediate transport unit 58. The fixing device 40 imparts heat and pressure to the recording medium P passing through the fixing nip NF. With this, the toner image is transferred to and fixed on the recording medium P.

Subsequently, in Step 208, it is determined whether or not there is an instruction of duplex printing. In a case where there is no instruction of duplex printing, the process proceeds to Step 210. In Step 210, the respective components of the post-processing unit 60 and the medium transport device 50 are instructed to output the recording medium P after performing the post-processing so as to finish the routine.

The recording medium P which is output from the fixing device 40 is processed by the post-processing unit 60 while being transported to the output medium receiving portion 541 outside the apparatus by the medium output unit 54. First, the recording medium P heated in a fixing step is cooled in the medium cooling unit 62. Then, the curve of the recording medium P is corrected by the correcting device 64. Further, regarding the toner image fixed on the recording medium P, the existence or the degree of a toner concentration defect, an image defect, an image position defect, and the like are detected by the image inspecting unit 66. In addition, the recording medium P is output to the medium output unit 54.

On the other hand, in the case where there is the instruction of the duplex printing, the process proceeds to Step 212. In Step 212, the respective components of the medium transport device 50 are instructed to cause the front surface and the back surface of the recording medium P to be reversed to each other such that the recording medium P is returned to the medium supply path 52P.

In a case where an image is formed on a non-image surface which is one surface of the recording medium P on which an image is not formed (the case of duplex printing), the controller 70 switches a transporting path of the recording medium P after passing through the image inspecting unit 66 into the branch path 56P1 of the medium returning unit 56 from the medium output path 54P of the medium output unit 54. With this, the recording medium P having the front surface and the back surface reversed to each other via the reverse path 56P is fed into the medium supply path 52P. An image is formed (fixed) on the back surface of the recording medium P in the same step as that of forming the image on the front surface as described above. The recording medium P goes through the same step as the above-described processing step performed after forming the image on the front surface, and then is output to the output medium receiving portion 541 outside the apparatus by the medium output unit 54.

Then, returning to Step 200, the processes from Step 200 to Step 210 are performed so as to finish the routine. In Step 208, it is determined that "there is no instruction of the duplex printing".

White Mode

Figure 8:
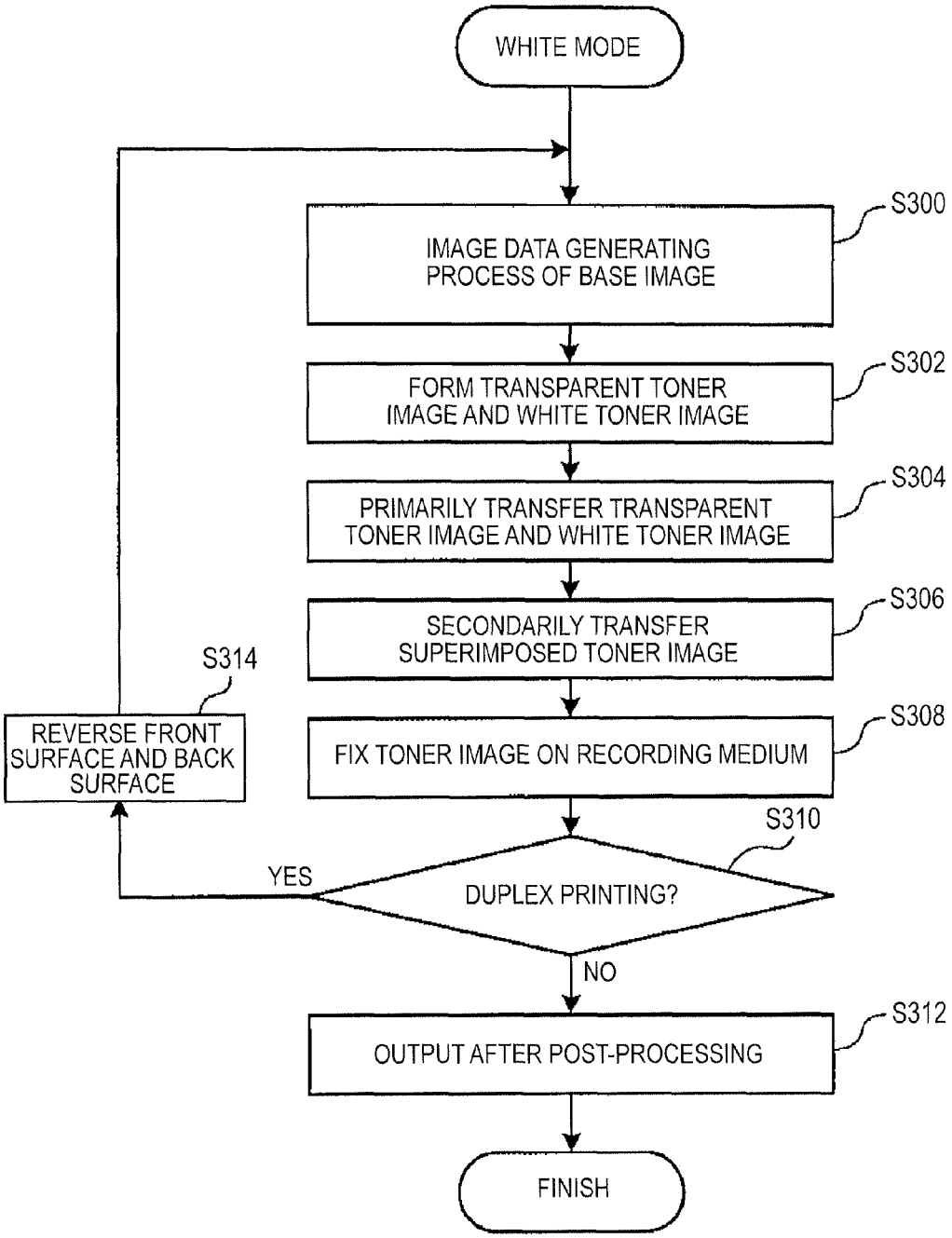
FIG. 8 is a flowchart illustrating an example of procedure of the image forming process in a white mode.

FIG. 8 is a flowchart illustrating an example of procedure of the image forming process in the "white mode". The image forming step in the "white mode" will be described with reference to FIG. 1 and FIG. 2. In the first exemplary embodiment, an example of forming the base toner layer with the transparent toner will be described. In addition, the description of a post-processing step and a duplex printing step is the same as that in the normal mode, and thus will be omitted.

Similar to the case of the normal mode, the controller 70 which receives the image forming command in the "white mode" operates the toner image forming unit 20, the transfer device 30, the fixing device 40, the medium transport device 50, the post-processing unit 60, and the like.

First, in Step 300, an "image data generating process of the base image" is performed. The image data of the white image is extracted from the image information so as to be set as image data of a base image to be formed with the transparent toner. For example, in a case where the white image is a solid image which is formed on the entire of the image forming region, the base image which is formed with the transparent toner also becomes a solid image which is formed on the entire of the image region. The toner image having the transparent toner is formed on a lower layer of a portion in which the toner image having the white toner is formed by setting the image data of the white image as the image data of the base image. In addition, in a case where an amount of deviation between a position in which the white image is formed and a position in which the base image is formed on the recording medium is recognized, the image data of the base image may be corrected in consideration of the amount of deviation such that the base image and the white image are overlapped with each other. For example, the image data of the base image is corrected such that the base image is made to be smaller than the white image.

Next, in Step 302, the respective components of the image forming unit 12 and the medium transport device 50 are instructed to form a transparent toner image and a white toner image. The toner image having the transparent toner is formed on the photoconductor drum 21V by the transparent (v) toner image forming unit 20V. Specifically, the photoconductor drum 21V is charged by a charging unit 22V, and is exposed to exposure light L in response to the image data of the base image by an exposure device 23V, and thereby an electrostatic latent image is formed on the surface of the photoconductor drum 21V. The electrostatic latent image which is formed on the photoconductor drum 21V is developed by using a developer containing the transparent toner supplied from the developing device 24V. With this, the toner image having the transparent toner is formed on the photoconductor drum 21V.

The toner image having the white toner is formed on the photoconductor drum 21W by the white (W) toner image forming unit 20W. Specifically, the photoconductor drum 21W is charged by a charging unit 22W, and is exposed to exposure light L in response to the image data of the white image by an exposure device 23W, and thereby an electrostatic latent image is formed on the surface of the photoconductor drum 21W. The electrostatic latent image which is formed on the photoconductor drum 21W is developed by using a developer containing the white toner supplied from the developing device 24W. With this, the toner image having the white toner is formed on the photoconductor drum 21W.

Next, in Step 304, the respective components of the image forming unit 12 and the medium transport device 50 are instructed to primarily transfer the transparent toner image and the white toner image. The toner image of each color which is formed on the photoconductor drum 21 for each color is sequentially transferred to the circulating transfer belt 31 through the applying of a transfer bias voltage through the primary transfer roller 33 for each color. With this, a superimposed toner image obtained by superimposing toner images of two colors is formed on the transfer belt 31. In the exemplary embodiment, the toner images of the two colors are superimposed in order of the white toner image and the transparent toner image from the transfer belt 31 side. The superimposed toner image is transported to the transfer nip NT by the circulation of the transfer belt 31.

Next, in Step 306, the respective components of the image forming unit 12 and the medium transport device 50 are instructed to secondarily transfer the superimposed toner image. The recording medium P is supplied to the transfer nip NT by the pairs of transport rollers 522R of the medium supply unit 52 in accordance with the timing of the transporting the superimposed toner image. When the transfer bias voltage is applied to the transfer nip NT, the superimposed toner image is transferred to the recording medium P from the transfer belt 31. After performing the transfer, the toner images of the two colors are superimposed in order of the transparent toner image and the white toner image from the recording medium P side.

Subsequently, in Step 308, the respective components of the image forming unit 12 and the medium transport device 50 are instructed to fix the toner image on the recording medium. The recording medium P to which the superimposed toner image is transferred is transported to the fixing nip NF of the fixing device 40 by the intermediate transport unit 58. The fixing device 40 imparts heat and pressure to the recording medium P passing through the fixing nip NF. With this, the toner image is transferred to and fixed on the recording medium P.

Subsequently, in Step 310, it is determined whether or not there is an instruction of duplex printing. In a case where there is no instruction of duplex printing, the process proceeds to Step 312. In Step 312, the respective components of the post-processing unit 60 and the medium transport device 50 are instructed to output the recording medium P after performing the post-processing so as to finish the routine.

The recording medium P which is output from the fixing device 40 is processed by the post-processing unit 60 while being transported to the output medium receiving portion 541 outside the apparatus by the medium output unit 54. In addition, the recording medium P is output to the medium output unit 54.

On the other hand, in the case where there is the instruction of the duplex printing, the process proceeds to Step 314. In Step 314, the respective components of the medium transport device 50 are instructed to cause the front surface and the back surface of the recording medium P to be reversed to each other such that the recording medium P is returned to the medium supply path 52P. Then, returning to Step 300, the processes from Step 300 to Step 312 are performed so as to finish the routine. In Step 310, it is determined that "there is no instruction of the duplex printing".

Figure 9:
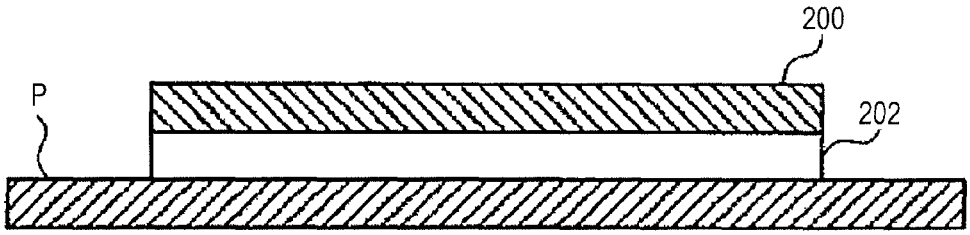
FIG. 9 is a sectional view illustrating an example of a stacking structure of toner layers which is formed on the recording medium in the first exemplary embodiment.

With the above-described operation, as illustrated in FIG. 9, a transparent toner layer 202 is inserted between a white toner layer 200 and the recording medium P as a "base toner layer". When the superimposed toner image is fixed, the transparent toner is soaked into the recording medium P, thereby filling the unevenness of the recording medium P, and thus it is possible to prevent the white toner from being soaked into the recording medium. With this, the white image is uniformly formed, and melting unevenness of the white toner which is caused by the white toner being soaked into the recording medium is reduced, thereby improving the whiteness.

In addition, the transparent toner does not absorb the light in a visible region, and thus the base toner layer formed with the transparent toner is not visually recognized. Accordingly, even in a case of forming the base toner layer formed with the transparent toner, the quality of the white image is not affected.

Second Exemplary Embodiment

The second exemplary embodiment is the same as the first exemplary embodiment except that "a base toner layer formed with a colored toner" is formed instead of the base toner layer formed with the transparent toner in the "white mode", and thus an operation performed in the "white mode" will be described without describing the configuration of the image forming apparatus.

Figure 10:
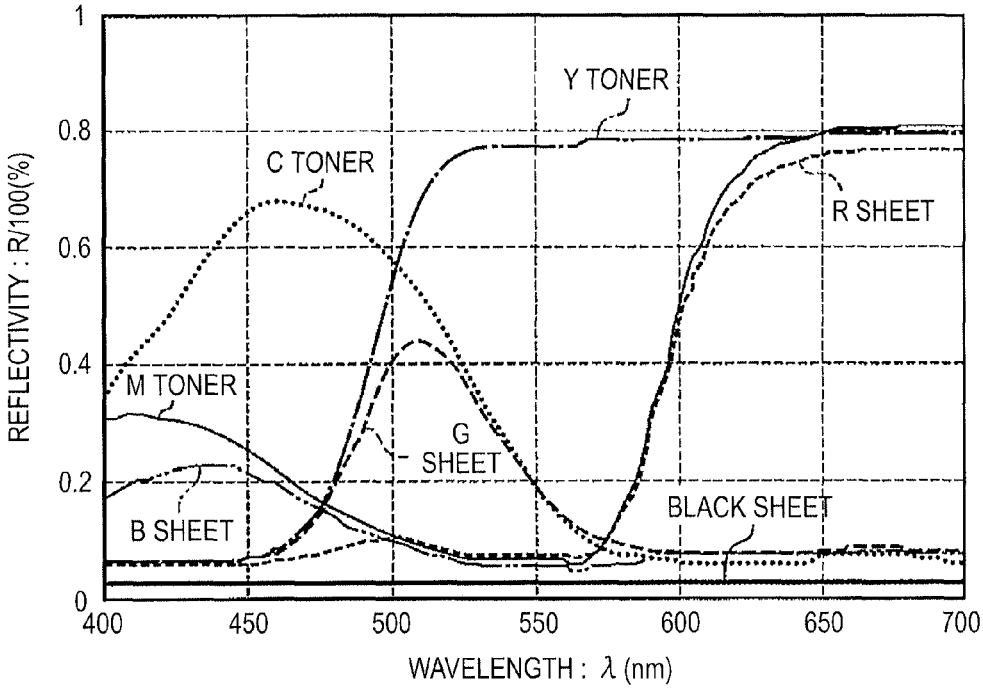
FIG. 10 is a graph illustrating an absorption wavelength region of the recording medium and an absorption wavelength region of colored toner.

FIG. 10 is a graph illustrating an absorption wavelength region of the recording medium and an absorption wavelength region of colored toner. A horizontal axis represents a wavelength λ, and a unit thereof is nm (nanometer). A vertical axis represents reflectivity (R/100), and a unit thereof is %. The light in the wavelength region having high reflectivity is reflected, and the light in the wavelength region having low reflectivity is absorbed.

In an example illustrated in FIG. 10, a blue sheet (B sheet) absorbs the light in the wavelength region having the wavelength which is equal to or greater than 530 nm. A green sheet (G sheet) absorbs the light in the wavelength region having the wavelength in a range of 400 nm to 450 nm, and equal to or greater than 600 nm. A red sheet (R sheet) absorbs the light in the wavelength region having the wavelength which is equal to or less than 570 nm. A black sheet (B sheet) absorbs the light in the entire wavelength region. In contrast, the C color toner absorbs the light in the wavelength region having the wavelength which is equal to or greater than 580 nm. The M color toner absorbs blue light having the wavelength around 440 nm and light having the wavelength in a range of 510 nm to 570 nm. The Y color toner absorbs the light in the wavelength region having the wavelength which is equal to or less than 450 nm.

For example, the absorption wavelength region (having the wavelength equal to or greater than 580 nm) of the C color toner is included in the absorption wavelength region (having the wavelength equal to or greater than 530 nm) of the blue sheet. In addition, the absorption wavelength region (having the wavelength equal to or less than 450 nm) of the Y color toner is included in the absorption wavelength region (having the wavelength in a range of 400 nm to 450 nm, and equal to or greater than 600 nm) of the green sheet. Further, the absorption wavelength region of the colored toner is necessarily included in the absorption wavelength region of the black sheet.

As such, even when the base image is formed with the particular colored toner having the absorption wavelength region which is included in the absorption wavelength region of the recording medium, the colored toner is not visually recognized. Hereinafter, a color of the "particular colored toner" which forms the base image is referred to as a "particular color". Accordingly, in the second exemplary embodiment, the relationship between the color of the recording medium and the particular color for forming the base image is stored in a table or the like in advance, and based on the aforementioned relationship, the base toner layer is formed with the colored toner having the particular color in accordance with the color of the recording medium.

Figure 11:
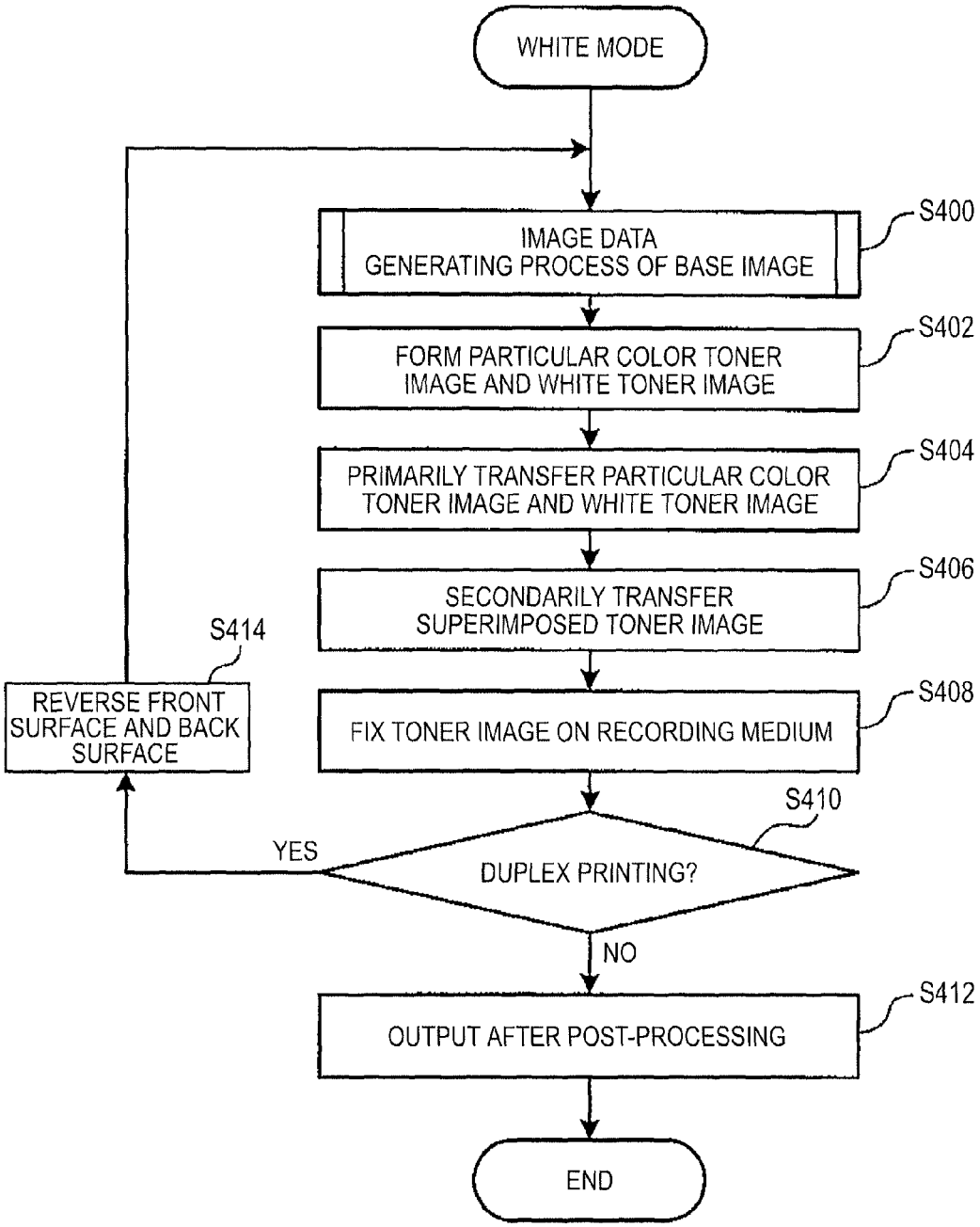
FIG. 11 is a flowchart illustrating an example of procedure of an image forming process in a white mode of a second exemplary embodiment.
Figures 12, 13:
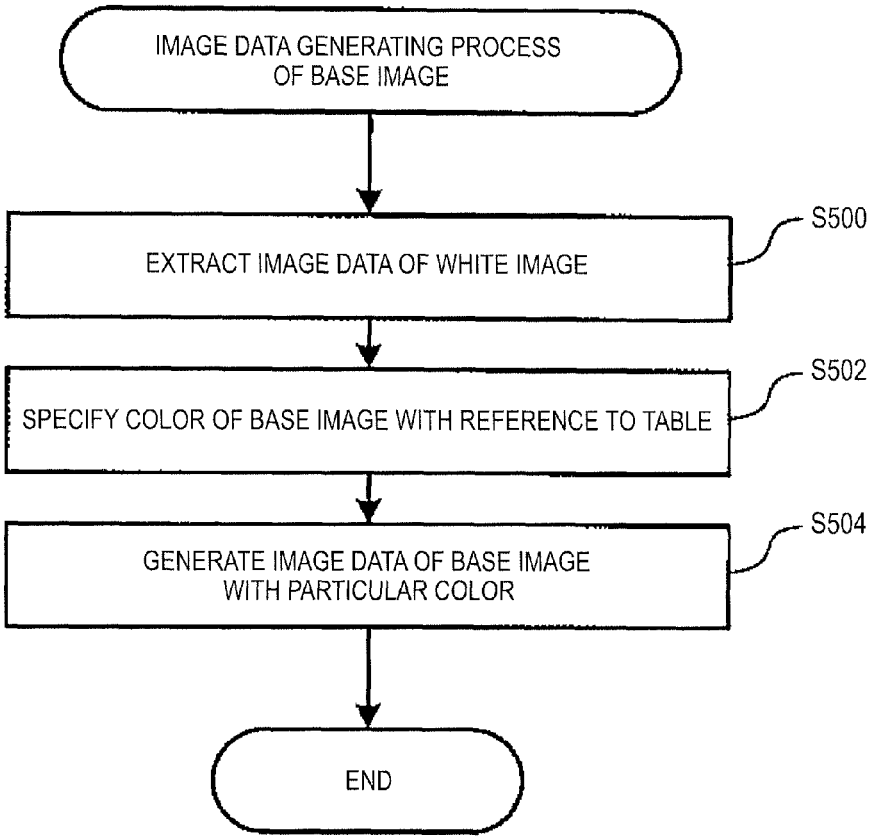
FIG. 12 is a flowchart illustrating an example of procedure of an image data generating process of a base toner layer.
FIG. 13 is a table indicating an example of a relationship between a color of a recording medium (sheet) and a particular color forming the base toner layer.

FIG. 11 is a flowchart illustrating an example of procedure of an image forming process in the "white mode" of the second exemplary embodiment. FIG. 12 is a flowchart illustrating an example of procedure of the "image data generating process of the base image". The image forming step in the "white mode" will be described with reference to FIG. 1 and FIG. 2. In the second exemplary embodiment, an example of forming the base toner layer with the colored toner will be described. In addition, the description of a post-processing step and a duplex printing step is the same as that in the normal mode, and thus will be omitted.

Similar to the case of the normal mode, the controller 70 which receives the image forming command in the "white mode" operates the toner image forming unit 20, the transfer device 30, the fixing device 40, the medium transport device 50, the post-processing unit 60, and the like.

First, in Step 400, an "image data generating process of the base image" as illustrated in FIG. 12 is performed. First, in Step 500, the image data of the white image is extracted from the image information. Next, in Step 502, a table in which the relationship between the color (sheet color) of the recording medium and the particular color for forming the base image is stored in advance is read out, and based on the relationship stored in advance, the particular color in accordance with the color information of the recording medium is determined. For example, in a case where the color of the recording medium is "pink", the "M color" is determined as the particular color with reference to the table illustrated in FIG. 13. In the following description, the particular color as the "M color" will be described.

Next, in Step 504, the extracted image data of the white image is set as the image data of the base image to be formed with the colored toner having the particular color. When the same image data is used, the toner image formed with the colored toner having the particular color is necessarily formed on a lower layer of a portion in which the toner image having the white toner is formed.

In this regard, the description is returned to the flowchart illustrated in FIG. 11. Subsequently, in Step 402, the respective components of the image forming unit 12 and the medium transport device 50 are instructed to form a particular color (M color) toner image and a white toner image.

The toner image having the M color toner is formed on the photoconductor drum 21M by the M color (M) toner image forming unit 20M. Specifically, the photoconductor drum 21M is charged by a charging unit 22M, and is exposed to exposure light L in response to the image data of the base image by an exposure device 23M, and thereby an electrostatic latent image is formed on the surface of the photoconductor drum 21M. The electrostatic latent image which is formed on the photoconductor drum 21M is developed by using a developer containing the M color toner supplied from the developing device 24M. With this, the toner image having the M color toner is formed on the photoconductor drum 21M.

In addition, the toner image having the white toner is formed on the photoconductor drum 21W by the white (W) toner image forming unit 20W. Specifically, the photoconductor drum 21W is charged by a charging unit 22W, and is exposed to exposure light L in response to the image data of the white image by an exposure device 23W, and thereby an electrostatic latent image is formed on the surface of the photoconductor drum 21W. The electrostatic latent image which is formed on the photoconductor drum 21W is developed by using a developer containing the white toner supplied from the developing device 24W. With this, the toner image having the white toner is formed on the photoconductor drum 21W.

Next, in Step 404, the respective components of the image forming unit 12 and the medium transport device 50 are instructed to primarily transfer the particular color (M color) toner image and the white toner image. The toner image of each color which is formed on the photoconductor drum 21 for each color is sequentially transferred to the circulating transfer belt 31 through the applying of a transfer bias voltage through the primary transfer roller 33 for each color. With this, a superimposed toner image obtained by superimposing toner images of two colors is formed on the transfer belt 31. In the exemplary embodiment, the toner images of the two colors are superimposed in order of the white toner image and the M color toner image from the transfer belt 31 side. The superimposed toner image is transported to the transfer nip NT by the circulation of the transfer belt 31.

Next, in Step 406, the respective components of the image forming unit 12 and the medium transport device 50 are instructed to secondarily transfer the superimposed toner image. The recording medium P is supplied to the transfer nip NT by the pairs of transport rollers 522R of the medium supply unit 52 in accordance with the timing of the transporting the superimposed toner image. When the transfer bias voltage is applied to the transfer nip NT, the superimposed toner image is transferred to the recording medium P from the transfer belt 31. After performing the transfer, the toner images of the two colors are superimposed in order of the M color toner image and the white toner image from the recording medium P side.

Subsequently, in Step 408, the respective components of the image forming unit 12 and the medium transport device 50 are instructed to fix the toner image on the recording medium. The recording medium P to which the superimposed toner image is transferred is transported to the fixing nip NF of the fixing device 40 by the intermediate transport unit 58. The fixing device 40 imparts heat and pressure to the recording medium P passing through the fixing nip NF. With this, the toner image is transferred to and fixed on the recording medium P.

Subsequently, in Step 410, it is determined whether or not there is an instruction of duplex printing. In a case where there is no instruction of duplex printing, the process proceeds to Step 412. In Step 412, the respective components of the post-processing unit 60 and the medium transport device 50 are instructed to output the recording medium P after performing the post-processing so as to finish the routine.

The recording medium P which is output from the fixing device 40 is processed by the post-processing unit 60 while being transported to the output medium receiving portion 541 outside the apparatus by the medium output unit 54. In addition, the recording medium P is output to the medium output unit 54.

On the other hand, in the case where there is the instruction of the duplex printing, the process proceeds to Step 414. In Step 414, the respective components of the medium transport device 50 are instructed to cause the front surface and the back surface of the recording medium P to be reversed to each other such that the recording medium P is returned to the medium supply path 52P. Then, returning to Step 400, the processes from Step 400 to Step 412 are performed so as to finish the routine. In Step 410, it is determined that "there is no instruction of the duplex printing".

With the above-described operation, a colored toner layer having the particular color is inserted between a white toner layer and the recording medium P as a "base toner layer". When the superimposed toner image is fixed, the colored toner is soaked into the recording medium P, thereby filling the unevenness of the recording medium P, and thus it is possible to prevent the white toner from being soaked into the recording medium. With this, the white image is uniformly formed, and melting unevenness of the white toner which is caused by the white toner being soaked into the recording medium is reduced, thereby improving the whiteness.

In addition, the light having the same wavelength as that absorbed by the colored toner having the particular color is absorbed in the recording medium, and thus the base toner layer which is formed with the colored toner having the particular color is not visually recognized. Accordingly, even in a case of forming the base toner layer formed with the colored toner having the particular color, the quality of the white image is not affected.

Modified Examples

The configuration of the image forming apparatus described in the exemplary embodiments is merely an example, and the configuration may be changed within the scope of the invention as defined by the appended claims.

The tandem type image forming apparatus is described in the above-described exemplary embodiments; however, in the image forming step in the "white mode", the superimposed toner image obtained by superimposing the base toner image and the white toner image on the recording medium may be formed, and a so-called rotary type image forming apparatus in which the development is performed by rotating a rotating body on which the plural developing devices are mounted, and causing the developing devices for plural colors sequentially to face or come in contact with the photoconductor may be employed.

In the above-described exemplary embodiment, the "normal mode" in which an image is formed with a colored toner on the recording medium is described; however, a configuration in which the white toner and the transparent toner are used in the "normal mode" may be employed. In this case, the first spot color (V) is set as white in the image forming unit 12 illustrated in FIG. 1 and FIG. 2, and the toner image forming unit 20V forms the toner image with the white toner. In addition, the second spot color (W) is set as the transparent color, and the toner image forming unit 20W forms the toner image with the transparent toner.

In the "normal mode", the toner image having a color corresponding to any one of transparent (W), yellow (Y), magenta (M), cyan (C), black (K), and white (V) is formed on the photoconductor drum 21 for each color. The superimposed toner image is formed in such a manner that the toner image which is formed for each color on the photoconductor drum 21 for each color is sequentially transferred to the transfer belt 31, and then the toner images of the six colors are superimposed on the transfer belt 31. The toner images of the six colors are superimposed in order of the transparent image, the Y color image, the M color image, the C color image, the K color image, and the white image from the transfer belt 31 side. Then, the superimposed toner image is transferred to the recording medium P from the transfer belt 31. After performing the transfer, the toner images of the six colors are superimposed in order of the white image, the K color image, the C color image, the M color image, the Y color image, and the transparent image from the recording medium P.

The second spot color (W) may not be transparent, but may be a user-specific corporate color which is frequently used when compared with other colors.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming unit that forms, when forming an image with a white toner on a colored recording medium that is not transparent and white, a base toner layer and a white toner layer in an overlapped manner such that the base toner layer is inserted between the white toner layer and the colored recording medium; and a fixing unit that fixes the base toner layer and the white toner layer that are formed by the image forming unit on the recording medium.

2. The image forming apparatus according to claim 1, wherein the image forming unit forms the base toner layer based on image information of a white image such that a white image and a base image are overlapped with each other.

3. The image forming apparatus according to claim 1, wherein the base toner layer is a transparent toner layer.

4. The image forming apparatus according to claim 1, wherein the base toner layer is a colored toner layer having an absorption wavelength region included in an absorption wavelength region of the color recording medium.

5. The image forming apparatus according to claim 1, wherein in a case of imparting a same amount of heat for the fixing, a storage modulus of a toner forming the base toner layer is lower than a storage modulus of the white toner.

6. The image forming apparatus according to claim 1, wherein, when forming an image with a colored toner that is not transparent and white on the recording medium, the image forming unit forms a colored toner layer on the recording medium.

* * * * *